United States Patent [19]

Varlonga

[11] 4,115,972

[45] Sep. 26, 1978

[54] FIXED AND MOVABLE FRAME FIXTURES FOR DOORS AND WINDOWS

[76] Inventor: Giovanni Varlonga, Piazza della Repubblica, 7, Milano, Italy

[21] Appl. No.: 799,019

[22] Filed: May 20, 1977

[51] Int. Cl.[2] ..... E04B 1/62

[52] U.S. Cl. ..... 52/398; 52/403; 49/504; 52/732; 49/DIG. 1

[58] Field of Search ..... 49/DIG. 1, DIG. 2, 504; 52/393-395, 397-399, 573, 207, 730, 732, 403

[56] References Cited

U.S. PATENT DOCUMENTS

| | | | |
|---|---|---|---|
| 3,462,884 | 8/1969 | La Bissoniere | 49/504 |
| 3,468,064 | 9/1969 | Fraleigh et al. | 49/DIG. 1 |
| 3,527,011 | 9/1970 | Bloom et al. | 49/DIG. 1 |

FOREIGN PATENT DOCUMENTS

| | | | |
|---|---|---|---|
| 972,180 | 10/1964 | United Kingdom | 52/730 |

*Primary Examiner*—James L. Ridgill, Jr.

*Attorney, Agent, or Firm*—Guido Modiano; Albert Josif

[57] ABSTRACT

A frame fixture assembly for doors and windows comprising a frame member driven into the wall and a movable frame member framing a door or window. Both the driven fixed frame member and the movable frame member framing the door or window include each a first metal section frame facing outwardly with respect to the wall outer face and a second metal frame substantially parallel to and aligned with the first frame but facing inwardly with respect to the wall inner face. A third frame is arranged between the two frames, acting as a seal between the two metal frames and is made of a thermally insulating material and interconnects the two metal frames by means of a joint connection formed in each such frames.

4 Claims, 7 Drawing Figures

FIXED AND MOVABLE FRAME FIXTURES FOR DOORS AND WINDOWS

BACKGROUND OF THE INVENTION

This invention relates to fixed and movable frame fixtures for doors and windows.

The instant fixtures are useful in all those applications wherein the conventional fixture are used, such as one- or two-wing doors or windows, bottom hung or jutting windows, horizontal and vertical center hung windows and doors, as well as fixed pane windows and curtain walls in general.

Modern building techniques have developed in this field a distinct trend towards metal frame fixtures, particularly towards frames formed from aluminium sections, owing to the ease of insertion of such sections in the bearing structures, their quick assembling features in the field, and the high degree of accuracy obtainable therewith, which eliminates in practice the need of carrying out adjustments during the installation. Their competitive cost and ease of transportation, for example with respect to the concrete prefabricated window bays, have also contributed to the widespread acceptance of metal frame fixtures. Specific problems connected with some special window designs, have also been conveniently solved thanks to the section adaptability to suit a variety of different requirements.

However, the very presence of a metal, which is advantageous for many aspects, brings about an inconvenience that in some cases may develop into a serious problem. Such an inconvenience results from the high thermal conductivity of metals in general, which for aluminium reaches values very close to the known maxima. In very cold climates and seasons, the thermal conductivity of the fixture frames around doors and windows creates within the house cold wall areas, as the sections extend, cross-section-wise, continuously from the outer surface to the inner one of a wall. Still more inconvenient than the loss of heat through this path, which may be limited owing to the small surface exposed and low rate of exchange between air and metal, is the presence of cold spots in a heated room, since these act as condensation centers even when the room relative humidity is very low. It is a generally recognized fact that condensation within a room is to be prevented as far as possible.

SUMMARY OF THE INVENTION

Accordingly, it is a general object of this invention to obviate the cited drawback in the prior art door and window fixtures, as indicated.

It is a particular object of the invention to provide a fixture frame of the type mentioned above, which while retaining a metal type of construction and all the benefits inherent thereto, avoids metal continuity through the fixture from the outer surface to the inner surface thereof.

It is a significant particular object of this invention to provide in the above fixtures a thermal barrier, or thermal break, such as to allow for the metal parts of the fixture facing the room or space inside to reach in practice the same temperature level prevailing within the room or space, and this independently of the outside temperature level.

These and other objects, such as will be apparent hereinafter, are all achieved by a frame fixture assembly for doors and windows, according to the invention, comprising at least one frame member driven into the wall and possibly a movable frame member framing a door or window, characterized in that both the or each driven fixed frame member and any movable frame member framing the door or window include each a first metal section frame facing outwardly with respect to the wall outer face and a second metal frame substantially parallel to and aligned with said first frame but facing inwardly with respect to the wall inner face, a third frame intervening between said two frames, acting as a seal between the two metal frames, made of a thermally insulating material and interconnecting the two metal frames by means of a joint connection formed in each such frames.

BRIEF DESCRIPTION OF THE DRAWINGS

The features, advantages and mode of application of the instant invention will be apparent from the detailed description of preferred, though not exclusive, embodiments thereof, provided hereinafter by way of example only with reference to the accompanying drawings, where.

DESCRIPTION OF THE PREFERRED EMBODIMENTS

Figure 1:
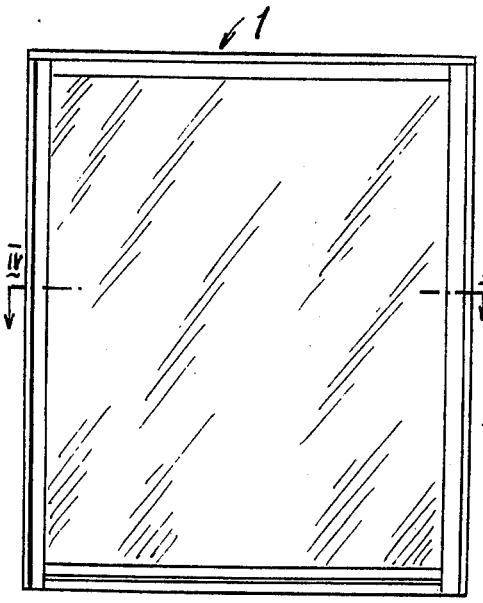
FIG. 1 is a front view of a fixed window or glazed opening.
Figures 4, 5, 6:
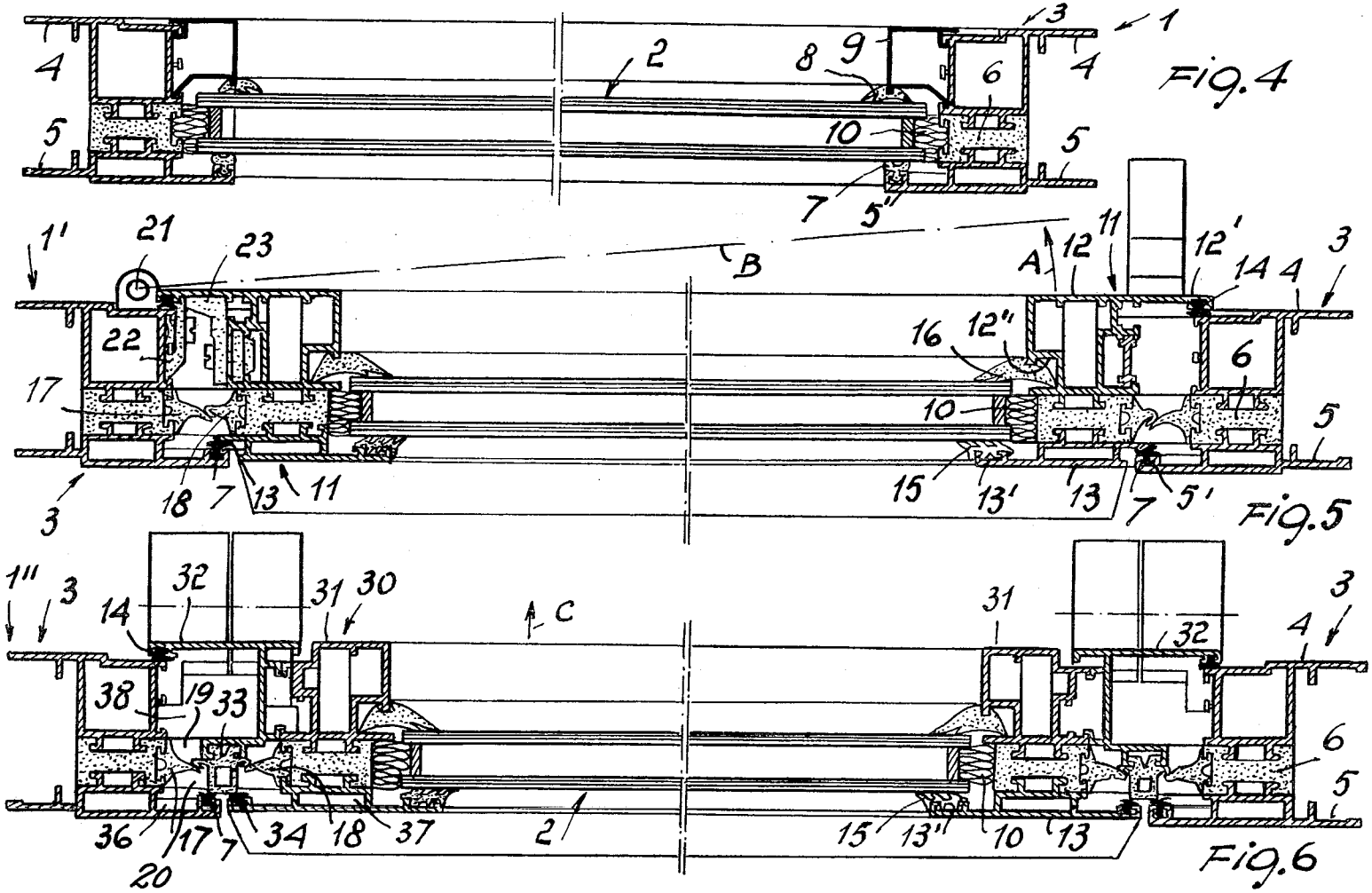
FIG. 4 is a sectional view taken along the line IV—IV of FIG. 1.
FIG. 5 is a sectional view taken along the line V—V of FIG. 2.
FIG. 6 is a sectional view taken along the line VI—VI of FIG. 3.

The view of FIG. 1 and the related cross-sectional view in FIG. 4 are representative of the most basic form of application of the invention, i.e. that of a fixed glazed window, denoted generally with the reference numeral 1. Such a fixture design finds application both in windows which cannot be opened, for spaces equipped with a central air conditioning system, and in glazed walls. For all the three window designs considered, the instance has been assumed of twin panes enclosing a gap therebetween, also referred to as chamber glazing, denoted with the numeral 2. In the instant window, one fixed fixture is provided, or inserted frame member 3 acting as a framing or casing and supporting the chamber glazing 2. The inserted fixture 3, or fixture driven into the wall, is composed of two metal frames 4 and 5 driven into the wall and forming an integral body through the interposition of a double joint connection 6 therebetween, jointed to both members. The frame 4 faces inwardly with respect to the building and has a substantially squared "P" profile, the leg of the "P" projecting circumferentially to form an edge or flange for the insertion of the fixture into the wall. The frame member 5 is instead exposed to the wall outside, is also profiled, with a projecting edge or lip similar to the edge of the frame 4, and a lip 5' projecting inwardly to form a peripheral resting edge adapted to accomodate the chamber glazing 2 in abutment engagement with a seal 7. A second seal or gasket 8, overlying the seal 7, on the other face of the chamber glazing pane is placed under the attachment molding 9, affixed internally to the frame 4. The coupling or seam 6 is approximately coplanar with the double pane 2, wherefrom it is separated by an insulating cord 10, e.g. of glass wool and acting as a gland, and the combination including the pane, cord and coupling forms a continuous thermal shield or break free from thermal conductive paths therethrough, not even local ones such as rivets or similar fasteners, since the mechanical connection is ensured by the jointed coupling 6, as detailed hereinafter.

Figure 2:
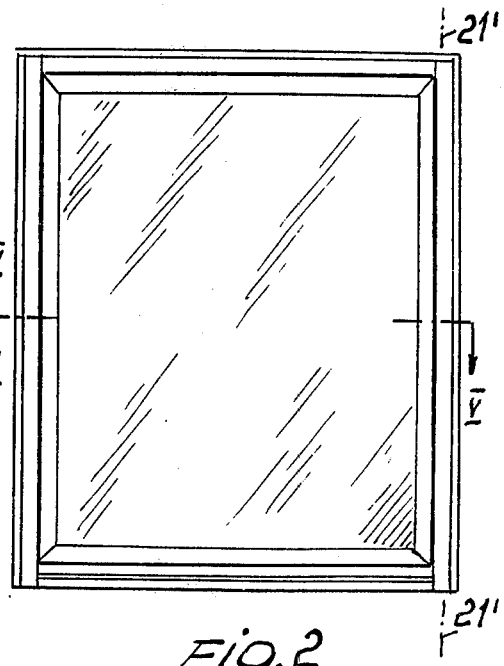
FIG. 2 is a front view of a single-wing hung window.

Turning now to FIGS. 2 and 5, there is shown therein a one-wing hung type of window 1' which may be opened to the inside, in connection wherewith a fixture will be next discussed having a fixed frame intended to receive the window when closed, and a movable frame which surrounds the window and follows it as an edge thereof.

The parts of the following windows which happen to be similar or equivalent to the preceding ones will be preferably denoted with the same reference numerals and assumed to be conventional. In particular, the inserted frame or fixed frame member 3 is entirely similar, or identical, to the preceding one, allowance being made for size differences. A similar movable frame member 11 is arranged, when the window is in its closed condition, concentrically within and surrounded by the inserted frame member 3, according to an arrangement which is quite common for this type of fixtures. The movable frame 11 is similarly formed by two side-by-side metal frames, one facing the house inside 12 and the other the house outside 13, these being united together by means of a double joint connection similar to the one just described. The frame 12 is formed from a section having a profile shape essentially "*b*" like, with a leg 12' projecting peripherally outwards and carrying a seal 14 intended for sealing against an outer corner of the frame 4 in abutment relationship. The frame 13 is also a section, rather flattened and provided with a leg 13' projecting peripherally inwards to provide support for the double glazed pane 2 with the interposition of a gasket 15. The double glazed pane 2 is locked by a further gasket or seal 16 resting on the contour portion of the opposite face of the double glazed pane, and joint engages a recess 12" of the section 12. When the window is closed, an edge 13" of the frame 13 abuts the gasket 7 of the fixed frame 5 in a tight sealing engagement. In such a position, the two insulating joints 6 and 6 are concentrical to each other and coplanar. In order to provide here too a thermal break or shield, extending continuously between the two insulating joints, one being fixed and the other movable, there are inserted two insulating strips 17 and 18 respectively affixed adjacent the two joints. The strips have a cross-sectional configuration formed with a projecting tongue, are of a soft material, and interfere with each other such as to form a diaphragm dividing the space whereinto they project into two interspaces 19 and 20, one being in contact with the inner frame 12 and the other with the outer one 5, and being both made watertight by the provision of the seals 14 and 7, thereby the thermal insulation feature is further enhanced. The window is pivotable in the direction indicated by the arrow A and by the dash and dot line B, about the axis 21' of pintle 21, in hinges 22 and 23.

Figure 3:
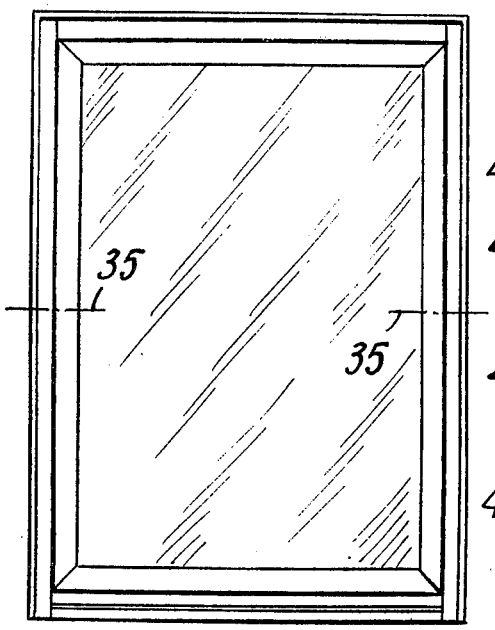
FIG. 3 is a front view of a horizontal center hung window.

The third window shown in FIGS. 3 and 6 is of the center hung type, i.e. tiltable about a horizontal axis 35—35. The object of creating, when the window is closed, a continuous thermal break or barrier is complicated here by the fact that part of the window tilts inwardly, in the direction of the arrow C, whilst part of the window tilts outwardly. This poses a problem which has been solved in the following manner. The fixture retains the fixed frames 4 and 5 and the movable frame 13, similarly to the previously discussed windows, and further comprises a movable frame 31 facing inwardly, which corresponds to a portion only of the movable frame 12 described above; it includes also an intermediate frame 32 which is cut peripherally into two polygonal portions. One polygonal portion of the frame 32, corresponding to that part of the window which moves in the direction of the arrow C, is rigid with the movable frame 31, as shown in FIG. 6; the remaining polygonal portion of the section or frame 32, not shown, being rigid with the fixed frame 4. The frame 32 carries an insulating strip 33 having an approximately rectangular cross-section and projecting wings. The strip 33 engages with its wings, in a tight seal relationship, the tongues of the two strips 17 and 18, respectively, and the projecting face of the rectangle closes tightly onto both the fixed gasket 7 and movable gasket 34. Here too the continuity of the thermal barrier or break has been effectively ensured and is formed by the chamber glazing 2, gland cord 10, movable joint connection 6, set of strips 18, 34 and 17, and by the fixed joint connection or coupling 6. The three insulating strips now divide the space, wherein they create a barrier, into three interspaces 36, 37 and 38, which are all sealed tight and thus ensure a good thermal insulation, similar to the previously discussed windows of simpler construction.

Figure 7:
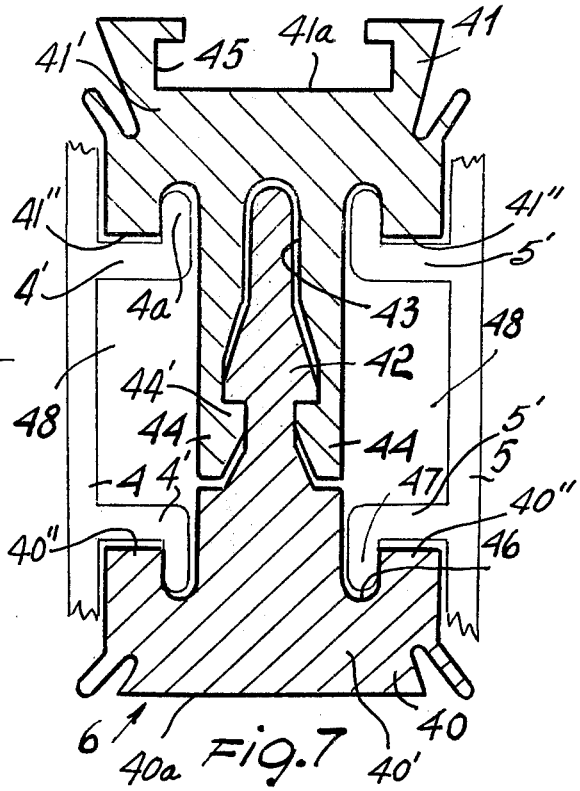
FIG. 7 is an enlarged view of a detail of a fixture according to the invention, derived from FIGS. 4–6.

FIG. 7 shows in detail, even though not essential, the double joint connection 6 mounted, for example, between a frame member 4 and frame member 5. Preferably, but not necessarily, the joint 6 is in two pieces, 40 and 41, specifically two sectional strips adapted to snap engage in an automatically permanent manner. In cross-section, the strip 40 is formed with a wedge 42 effective to be inserted into a corresponding recess 43 in the mating strip 41, between two snap-on retaining jaws 44. The strip 41 is also provided with a grooved guide or joint groove or cavity 45 for insertion therein of a sealing strip 17 (or, respectively, 18). Each strip 40 and 41 has two hollow guides 46 wherein wings 47 of the metal sections 4 and 5 engage such that by clamping together with a snap action the two strips and wings inserted in the guides the two sections are permanently connected to each other to form an integral frame and, together with the wings, stiffening metal ribs for the joint, thereby the frame itself, while having no metal continuity between its two faces, exhibits nearly the same mechanical strength as an equivalent one-piece section. It should be noted that across the path of the thermal flux to be barred, owing to the construction provided, there are met two interspaces or cavities 48 which also contribute to the barring of the thermal flux. The groove 43, by virtue of its clearance about the wedge 42, also increases the resistance to the dispersion of heat through conduction. These additional provisions are so effective, per se, in barring the heat flux that the selection of the material for the insulation 6, as well as for the strips 17, 18 and 33, may be made from ordinary plastics, known to be generally poor conductors, following criteria of mechanical, good gas sealing properties, resistance to brittleness in cold weather, nature rather than based upon mere thermal insulation properties. By way of example, suitable materials are PVC and polyethylene.

It will be appreciated from FIG. 7 of the drawing, that the parts or pieces 40 and 41 of the jointing insulating member or double joint connection 6 have each a general T-like cross-section of which the above said snap-on or retaining jaws partly coincide with the web of the T-shape of the part 41 and the wedge 42 partly coincides with the web of the T-shape of part 40 of the joint member 6. It will be further noted that the metallic frame members or parts 4, 5 have each on the side facing the interposed jointing insulating member a pair of spaced apart L-like ledge formations 4', 5' the wings or projecting legs **4*a*, 47 of which are received in the undercut grooves or hollow guides 46 provided in the reverse surfaces 40'' and 41''. It will be further appreciated from the drawing that the obverse surfaces 40*a* and 41*a* are arranged in a position which is unobstructed by said metallic frame parts 4 and 5**.

It has thus been shown how the objects set forth are achieved by the invention through approaches which are rather elaborate and thermotechnically sophisticated, but also simple and convenient from the standpoint of construction and installation, while ensuring substantially decisive advantages to be reached. It is within the capabilities of any experts in the construction and heat propagation arts to introduce shape and design variations, based upon the teachings of this invention as described hereinabove, to achieve the same objects. It will be understood that such variations and modifications fall within the scope of the instant invention.

I claim:

1. In an insulated composite metal frame for doors and windows with superimposed metallic frame parts and a jointing insulating member arranged between the superimposed metallic frame parts, wherein the metallic frame parts are arranged in parallel planes and are constituted from metallic profile sections and wherein the interposed jointing insulating member is coextensive therewith, connection means comprising said jointing insulating member composed of two coextensive parts snap engaged with each other, each of said coextensive insulating member parts having a T-like cross-section with an integral flange portion and an integral web portion, the flange portion having a reverse surface extending transverse to said web portion and facing the side where the web portion extends and the flange portion having an obverse surface extending transverse to said web portion and facing in a direction opposite to the extension of said web portion, a first one of said coextensive insulating member parts having an engagement groove in the web portion thereof opening at the free end of said web portion and coextensive therewith, the opening of said groove having a narrowing with respect to the width of the engagement groove, a second one of said coextensive insulating member parts having part of its web portion in the form of a tongue formation coextensive therewith and having an arrow like shape and adapted to penetrate into said engagement groove and be anchored by said narrowing therein, said integral web portions of each of said coextensive insulated mutually engaging member parts having on both sides thereof coplanar lateral surfaces extending parallel to said parallel planes of said metallic frame parts and an undercut groove in each of said reverse surfaces thereof to provide an elongated engagement seat therein; said metallic frame parts having each on the side facing said interposed jointing insulating member a pair of opposite spaced apart L-like ledge formations having each projecting legs of the L-shape engaged into the respective said undercut grooves thereby to provide connection between two superimposed metallic frame parts facing coextensively said interposed insulating member on both lateral sides thereof, said obverse surfaces being arranged in a position unobstructed by said metallic frame parts.

2. Insulated composite metal frame according to claim 1, wherein said engagement groove and said tongue formation have selectd dimensions allowing sporadic clearances therebetween in engaged conditions thereof whereby to provide interspaces increasing the insulation effect.

3. An insulated metal frame according to claim 1, wherein said ledge formations provide cavities therebetween further increasing the insulation effect.

4. An insulated metal frame according to claim 3, wherein at least one of said obverse surfaces of said jointing insulating member has a jointing groove for connection with a further sealing strip.

* * * * *

UNITED STATES PATENT OFFICE

CERTIFICATE OF CORRECTION

Patent No. 4115972 Dated September 26, 1978

Inventor(s) GIOVANNI VARLONGA

It is certified that error appears in the above-identified patent and that said Letters Patent are hereby corrected as shown below:

On the face page between item No. 22 and No 51 insert the following item to read as follows:

[30] Foreign Application Priority Data

May 24, 1976 [IT] Italy..... 23549 A/76

Signed and Sealed this

*Seventeenth* Day of *June 1980*

[SEAL]

*Attest:*

SIDNEY A. DIAMOND

*Attesting Officer*

*Commissioner of Patents and Trademarks*